US010450683B2

(12) United States Patent
Hirayama et al.

(10) Patent No.: US 10,450,683 B2
(45) Date of Patent: Oct. 22, 2019

(54) SEWING SYSTEM

(71) Applicant: JUKI CORPORATION, Tokyo (JP)

(72) Inventors: Motoki Hirayama, Tokyo (JP); Jirou Obama, Tokyo (JP)

(73) Assignee: JUKI CORPORATION, Tokyo (JP)

( * ) Notice: Subject to any disclaimer, the term of this patent is extended or adjusted under 35 U.S.C. 154(b) by 61 days.

(21) Appl. No.: 15/498,546

(22) Filed: Apr. 27, 2017

(65) Prior Publication Data

US 2017/0314175 A1 Nov. 2, 2017

(30) Foreign Application Priority Data

Apr. 28, 2016 (JP) ..... 2016-090137

(51) Int. Cl.
*D05B 19/16* (2006.01)
*D05B 21/00* (2006.01)
*D05B 35/00* (2006.01)

(52) U.S. Cl.
CPC ..... *D05B 19/16* (2013.01); *D05B 21/00* (2013.01); *D05B 35/00* (2013.01); *D05D 2207/04* (2013.01)

(58) Field of Classification Search
CPC ..... D05B 19/00; D05B 2/16; D05B 21/00; D05B 35/00; D05D 2207/00; D05D 2207/02; D05D 2207/04
USPC ..... D15/66, 69, 72, 78, 199
See application file for complete search history.

(56) References Cited

U.S. PATENT DOCUMENTS 3,621,801 A * 11/1971 Huddleston ..... A41H 42/00 101/287
4,498,404 A * 2/1985 Sadeh ..... D05B 21/00 112/308
4,608,936 A * 9/1986 Ball ..... B26D 1/185 112/104
4,688,499 A * 8/1987 Moore ..... A41H 42/00 112/122
4,915,040 A * 4/1990 Sakuma ..... A41D 27/10 112/104
4,932,343 A * 6/1990 Mardix ..... D05B 21/00 112/308
5,313,897 A * 5/1994 Katamine ..... B25J 15/0019 112/470.13
5,349,913 A * 9/1994 Schramayr ..... D05B 23/00 112/470.13
5,406,900 A * 4/1995 Schramayr ..... D05B 23/00 112/104

(Continued)

FOREIGN PATENT DOCUMENTS

JP S61-265169 A 11/1986

*Primary Examiner* — Ismael Izaguirre
(74) *Attorney, Agent, or Firm* — Drinker Biddle & Reath LLP

(57) ABSTRACT

According to the sewing system of the present embodiment, the sewing machine and the robot arm are fixedly supported at the fixed positions by the base. Therefore, when a target position of the robot arm for the sewing operation is set once, a relative positional relation between the robot arm and the sewing machine is kept by the base even though the sewing system is entirely moved. Therefore, it is not necessary to again perform a setting operation of the target position for the sewing operation, so that the burdens on the teaching operation and the other setting operations are reduced.

4 Claims, 8 Drawing Sheets

(56) References Cited

U.S. PATENT DOCUMENTS

| | | | | | |
|---|---|---|---|---|---|
| 5,875,726 | A * | 3/1999 | Keilmann | B25J 9/0084 | 112/470.13 |
| 5,988,085 | A * | 11/1999 | Martz | D05B 39/00 | 112/470.13 |
| 6,324,444 | B1 * | 11/2001 | Wakaizumi | B25J 9/1635 | 318/568.11 |
| 7,984,681 | B1 * | 7/2011 | Oxley | D05B 11/005 | 112/153 |
| 2007/0033778 | A1 * | 2/2007 | Rey | A41H 43/0228 | 28/100 |
| 2008/0192104 | A1 * | 8/2008 | Nye | B41J 3/4073 | 347/110 |

* cited by examiner

SEWING SYSTEM

CROSS-REFERENCE TO RELATED APPLICATION

The present application claims the benefit of priority of Japanese Patent Applications No. 2016-090137, filed on Apr. 28, 2016, the present invention of which is incorporated herein by reference.

TECHNICAL FIELD

The present invention relates to a sewing system including a robot arm.

BACKGROUND ART

A sewing system configured to supply a workpiece to a sewing machine and to move a cloth so as to drop a needle to a predetermined needle drop position with holding the workpiece has been suggested (for example, refer to Japanese Patent Application Publication No. S61-265169A). The sewing system includes a robot arm having a suction hand configured to suck the workpiece and mounted to a tip end portion of the robot arm.

In the sewing system having the robot arm, it is necessary to perform an operation referred to as so-called teaching operation for teaching a controller of the robot arm respective positions such as a receiving position of the workpiece, a sewing position of the sewing machine, a stock position of the workpiece for which a sewing operation has been completed, and the like.

However, according to the sewing system, since the sewing machine and the robot arm are independently provided, a positional deviation occurs therebetween when the sewing system is moved or rearranged, so that the teaching operation should be again performed.

SUMMARY OF THE PRESENT INVENTION

The present invention is to provide a sewing system capable of reducing a troublesome teaching operation, and has any one feature of following configurations (1) to (6).

(1) A sewing system comprising:

a sewing machine configured to sew a workpiece;

a robot arm which the workpiece is to be detachably held thereto and which is configured to position the held workpiece relative to the sewing machine and to enable any sewing operation, and a base to which the sewing machine and the robot arm are fixedly supported at fixed positions.

(2) The sewing system according to (1), wherein the robot arm is configured to hold the workpiece through a clamp jig, and wherein a coupling structure configured to be detachably mounted from the robot arm-side and to hold the clamp jig at a predetermined posture is provided between the robot arm and the clamp jig.

(3) The sewing system according to (1) or (2), further comprising a conveyor device comprising a mounting unit to which the clamp jig is to be mounted at a predetermined posture and configured to convey the mounting unit between an operation position at which an operation of mounting the clamp jig to the mounting unit is to be performed and a transfer position at which the clamp jig mounted to the mounting unit is to be transferred to the robot arm, wherein the conveyor device is fixedly supported at a fixed position of the base.

(4) The sewing system according to one of (1) to (3), further comprising a display device supported at a fixed position of the base and configured to indicate a moveable range of the robot arm, wherein the conveyor device is arranged so that the operation position is located at an outside of the moveable range and the transfer position is located at an inside of the moveable range.

(5) The sewing system according to (3) or (4), wherein the conveyor device is configured to transfer the clamp jig to the robot arm at the transfer position, in the same posture and direction as a posture and a direction of the clamp jig mounted to the mounting unit at the operation position.

(6) The sewing system according to one of (1) to (5), wherein the base comprises a wheel for moving.

Means for Solving Problems

According to the sewing system of the present invention, the sewing machine and the robot arm are fixedly supported at the fixed positions by the base. Therefore, when a target position of the robot arm for the sewing operation is set once, a relative positional relation between the robot arm and the sewing machine is kept by the base even though the sewing system is entirely moved. Therefore, it is not necessary to again perform a setting operation of the target position for the sewing operation, so that the burdens on the teaching operation and the other setting operations are reduced.

DETAILED DESCRIPTION

Overall Configuration of Sewing System

Figure 1:
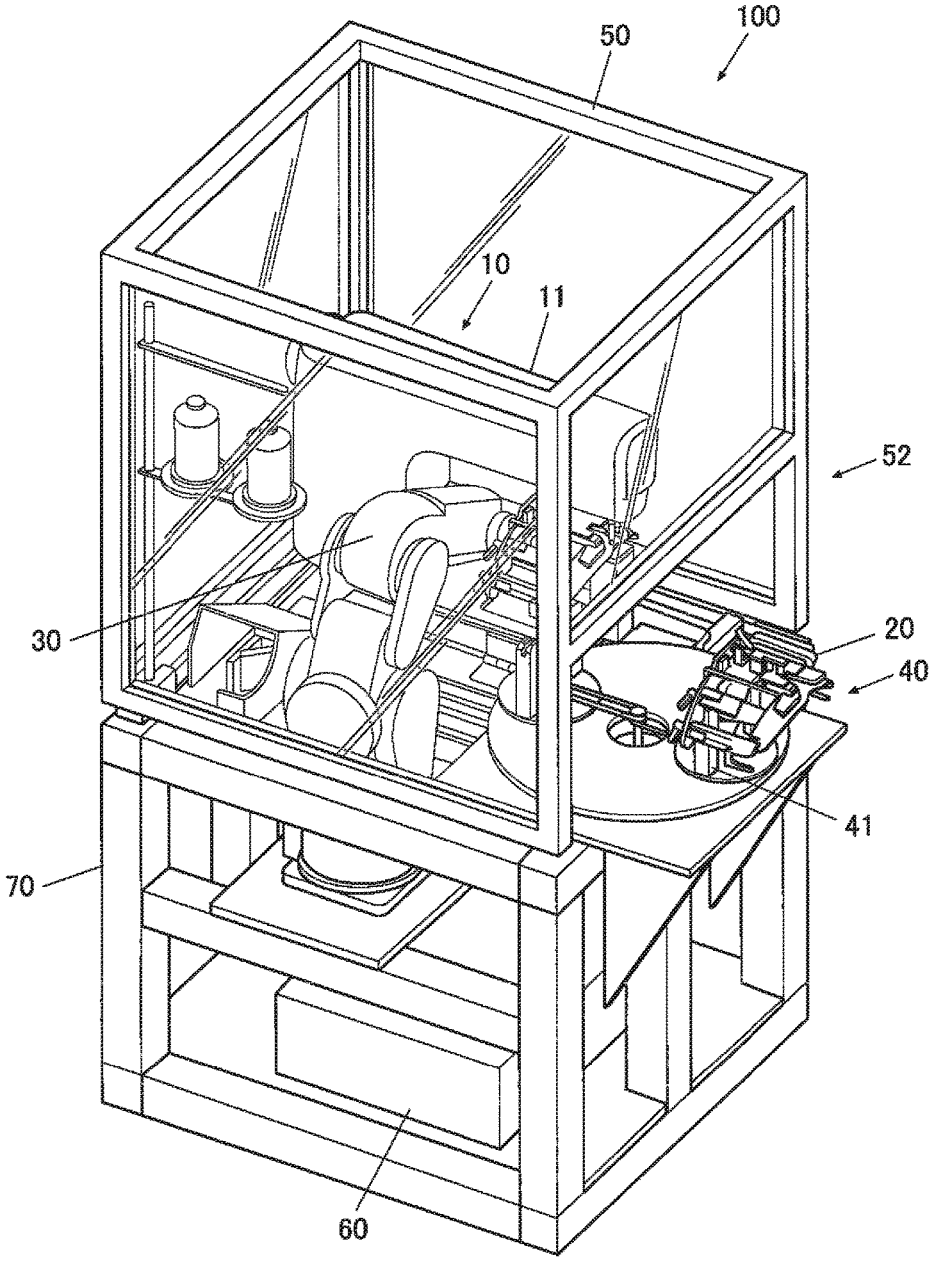
FIG. 1 is a perspective view depicting an overall configuration of a sewing system in accordance with an illustrative embodiment of the present invention.

Hereinafter, a sewing system 100 in accordance with an illustrative embodiment of the present invention will be described with reference to the drawings. FIG. 1 is a perspective view depicting an overall configuration of the sewing system 100.

The sewing system 100 includes a sewing machine 10 configured to sew a workpiece, a clamp jig 20 configured to detachably hold the workpiece, a robot arm 30 configured to position the workpiece held by the clamp jig 20 relative to the sewing machine 10 and to enable any sewing operation, a conveyor device 40 configured to transfer the clamp jig 20 to the robot arm 30 by moving a mounting unit 41 configured to mount thereto the clamp jig 20 at a predetermined posture, a display device 50 configured to indicate a moveable range of the robot arm 30, a controller 60 configured to control operations of the constitutional elements, and a base 70 configured to fix and support all of the constitutional elements at individual fixed positions.

Sewing Machine

The sewing machine 10 includes a needle bar configured to hold a sewing needle at a lower end portion thereof, a needle bar vertical movement mechanism configured to vertically move the needle bar, a shuttle mechanism configured to catch a needle thread threaded through the sewing needle and to entwine a bobbin thread with the needle thread, a presser foot mechanism configured to vertically move a presser foot, a balance mechanism configured to pull up the needle thread, a thread tension device configured to apply tension to the needle thread, and a sewing machine frame 11 configured to accommodate therein or support the constitutional elements.

Also, according to the sewing system 100, since the robot arm 30 moves the workpiece under sewing, a cloth feeding mechanism using a feed tooth is not provided. Alternatively, even when the cloth feeding mechanism is mounted, it is held at a rest state where the feed tooth is lowered to a position lower than a needle plate and is stopped.

The sewing machine frame 11 has a sewing machine bed part positioned at a lower part, a vertical body part standing up from the sewing machine bed part, and a sewing machine arm part extending from an upper end portion of the vertical body part, in parallel with the sewing machine bed part.

A front surface-side (a back surface-side is shown in FIG. 1) of the sewing machine frame 11 is provided with a balance of the balance mechanism, a thread guide configured to form a guide path of the needle thread, the thread tension device and the like.

The needle bar vertical movement mechanism has a well-known configuration including an upper shaft configured to rotate by a sewing machine motor 12 (refer to FIG. 5) (a driving source) and a crank mechanism configured to convert a rotational force of the upper shaft into a driving force of vertical movement and to apply the same to the needle bar and thus the specific description thereof is omitted.

The shuttle mechanism has a well-known configuration including a so-called horizontal shuttle, a shuttle shaft configured to support the horizontal shuttle, a lower shaft configured to rotate by the sewing machine motor 12, and a transmission mechanism configured to transmit the rotational force from the lower shaft to the shuttle shaft and thus the specific description thereof is omitted.

Also, the sewing machine 10 is a so-called post bed sewing machine, and is embedded in an upper part of a post bed where the horizontal shuttle is mounted to erect at a position of the sewing machine bed part below the sewing needle.

The presser foot mechanism has a well-known configuration including a presser foot bar configured to hold a presser foot at a lower end portion thereof and a crank mechanism configured to convert the rotational force of the upper shaft into a driving force of vertical movement and to apply the same to the presser foot bar and thus the specific description thereof is omitted.

The presser foot has a cylindrical part for loosely fitting therein a sewing needle and is configured so that the cylindrical part presses the workpiece from above upon rising of the sewing needle and rattling of the workpiece is thus suppressed.

The presser foot mechanism is configured to transmit an operation so that the presser foot is to enable the sewing needle to late perform the vertical movement, with the same period as the sewing needle. Thereby, the workpiece that is tensioned and raised upon the rising of the sewing needle is pressed, so that the sewing needle can be favorably pulled out from the workpiece.

Clamp Jig

Figure 2:
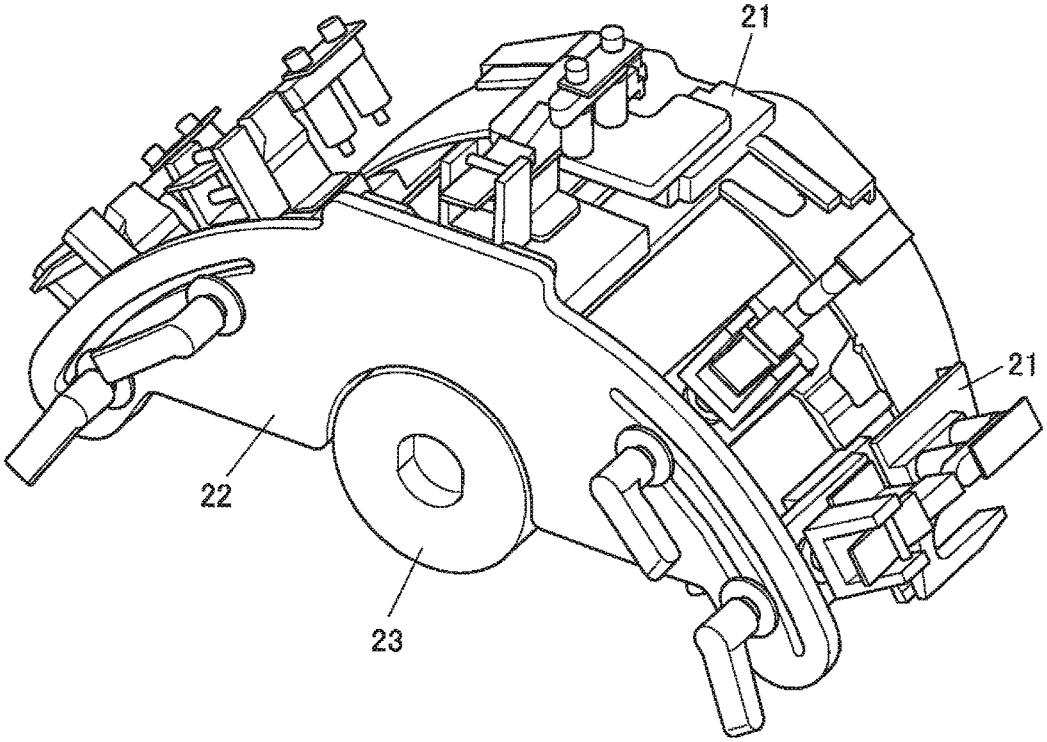
FIG. 2 is a perspective view of a clamp jig.

FIG. 2 is a perspective view of a clamp jig 20.

The clamp jig 20 includes a pair of clamp members one of which is supported to the other to be contactable and separable, a plurality of clamp units 21 each of which consists of a toggle mechanism configured to manually perform the contact and separation operation, and a frame 22 configured to support each clamp unit 21.

Each clamp unit 21 has a clamp surface configured to clamp the workpiece and arranged along one circumferential surface or curved surface, so that it can hold the workpiece along the circumferential surface or curved surface.

The toggle mechanism of each clamp unit has a toggle lever. When the toggle lever is rotated in a predetermined direction, the clamp members are opened, so that the workpiece can be inserted between the pair of clamp members, and when the toggle lever is rotated in an opposite direction, the clamp members are closed, so that a clamp state is formed.

The frame 22 has the plurality of clamp units at a front surface-side thereof and a tool plate 23 at a back surface-side thereof.

A coupling structure configured to be detachably mounted from the robot arm 30-side and to hold the clamp jig 20 at a predetermined posture is provided between the robot arm 30 and the clamp jig 20. The coupling structure includes a master plate 31 (refer to FIG. 5) mounted at a tip end portion of the robot arm 30 and a tool plate 23 mounted at the clamp jig 20-side. The tool plate 23 is fixedly mounted to the back surface-side of the frame 22 of the clamp jig 20.

The tool plate 23 is a circular plate, and a back surface-side thereof is configured as an attachment surface to the frame 22 and a front surface-side is configured as a surface to face the master plate 31. A central portion of the front surface of the tool plate 23 is formed with a circular opening, and an inner peripheral surface of the opening is formed with a holding groove.

In the meantime, the master plate 31 has a cylindrical protrusion, which is formed on a front surface to face of the tool plate 23 and can be inserted into the opening, and a plurality of locking balls capable of protruding and retreating from an outer peripheral surface of the protrusion is arranged along a circumferential direction. When an air pressure is supplied to an air pressure supply port provided on the outer peripheral surface of the master plate 31, the locking balls slightly protrude from the outer peripheral surface of the protrusion. That is, when the protrusion of the master plate 31 is inserted into the opening of the tool plate 23 and the air pressure is supplied from the air pressure supply port, the respective balls protrude and fit with the holding groove in the opening of the tool plate 23, so that a coupling state where the protrusion is not to be separated from the opening is made. Also, the master plate 31 has a discharge port through which the supplied compressed air is to be discharged. When air is exhausted through the discharge port, the coupling state is released, so that the master plate 31 and the tool plate 23 can be separated.

Also, two positioning pins protruding in the same direction as the protrusion are provided at twp places around the protrusion of the master plate 31, and two places around the opening of the tool plate 23 are formed with positioning holes in which the respective positioning pins are to be inserted upon coupling of the plates. By the positioning pins and holes, it is possible to prevent the tool plate 23 from rotating relative to the master plate 31 around the protrusion. Therefore, the robot arm 30 can hold the clamp jig 20 at a predetermined posture by the coupling structure having the master plate 31 and the tool plate 23.

Robot Arm

The robot arm 30 is a vertical multi-joint robot arm including a base, a plurality of arms coupled by joints, a servo motor 32 provided for each joint and functioning as a driving source, and an encoder 33 configured to detect an angle of an arm to be rotated by each servo motor, and the master plate 31 is mounted at a tip end portion of the plurality of arms coupled by the joints.

The master plate 31 can be mounted with the clamp jig 20 at a posture determined relative to the robot arm 30 through the tool plate 23.

Each joint is configured by any one of an oscillation joint configured to pivotally support the other end portion of the arm so that one end portion is enabled to oscillate and a rotation joint configured to pivotally support the arm so that the arm can rotate about a longitudinal direction thereof. The robot arm 30 has six joints, is configured to position the master plate 31 of the tip end portion thereof at any position by six shafts and can take any posture.

Therefore, when a target position is known, the robot arm 30 can freely receive the clamp jig 20 configured to hold the workpiece and convey the sewing machine 10, so that the robot arm can drop a needle to any needle drop position for forming an arbitrary sewing pattern of the workpiece held at the clamp jig 20 by the sewing machine.

Also, the present invention is not limited to the robot arm 30 having the six shafts, and a robot arm of seven shafts having seven joints may also be adopted. In this case, since a redundant joint occurs, it is possible to move the joint on the way while positioning the master plate 31 at any position and taking any posture, so that it is possible to avoid any interference with other constitutional elements around the robot arm 30. Therefore, it is possible to position the master plate 31 at any position within a wider range and to take any posture.

Base

The base 70 is a cubic case, and the sewing machine 10, the robot arm 30 and the conveyor device 40 are arranged and supported at an upper part of the base. Also, the controller 60 is accommodated in the base 70.

Four casters, which are wheels for moving the entire sewing system 100, may be individually mounted at four corners of a bottom surface of the base 70. Also, four earth leg parts may be provided in the vicinity of the respective casters 71. The earth leg part may have a vertically moveable earth plate for holding the sewing system 100 at a fixed position on a floor surface, and may be configured to move downward and fix the earth plate to a target position after the sewing system 100 is moved to the target position by the casters 71.

On the base 70, the sewing machine 10, the robot arm 30 and the conveyor device 40 are strongly fixed so that a positional relation thereof is not to easily change.

Therefore, since the relative positional relation of the sewing machine 10 and the conveyor device 40 relative to the robot arm 30 is held constant, when the relative positional relation thereof is input or taught in advance, the robot arm 30 can favorably and stably receive the clamp jig 20 from the conveyor device 40, convey the clamp jig 20 and the workpiece to the sewing machine 10, and return the workpiece for which the sewing has been completed and the clamp jig 20 to the conveyor device 40. Also, upon the sewing of the sewing machine 10, it is possible to sequentially position the workpiece so that the needle is to correctly drop to the workpiece.

Display Device

The display device 50 is a cubic case fixed to the upper part of the base 70 and includes a frame-shaped aggregate assembled along each side of the cuboid and a wall surface material covering the aggregate. Also, in FIG. 1, only the aggregate is shown and the wall surface material is not shown so as to indicate an internal structure.

An internal area formed by the aggregate and wall surface material of the display device 50 defines an entire moveable range of the robot arm 30, including the clamp jig 20 held at the tip end portion. That is, when the robot arm 30 is operated, the robot arm performs the operation so that all the parts, including the clamp jig 20, are not to go out of the internal area of the display device 50.

Also, the range defined by the internal area of the display device 50 does not indicate an operation limit based on a physical moveable range of the robot arm 30 but indicates a range in which all the parts of the robot arm 30, including the clamp jig 20, are controlled not to go out of the range by the controller 60.

In the display device 50, the robot arm 30 and the sewing machine 10 are arranged. Also, a front surface-side of the display device 50 facing the sewing machine 10 is provided with an openable door. Therefore, when performing a correction preparation operation or a maintenance operation for the sewing machine 10, an operator can directly access the sewing machine 10.

Also, another side surface of the display device 50 is formed at its lower part with an opening 52. The conveyor device 40 is arranged over the opening 52. A part of the conveyor device 40 is arranged at an inner side of the internal area of the display device 50, and the other remaining part is arranged at an outside of the display device 50.

The conveyor device 40 has a mounting unit 41 on which the clamp jig 20 is to be mounted at a predetermined posture, and is configured to convey the mounting unit 41 between an operation position at which the clamp jig 20 is to be mounted to the mounting unit 41 and a transfer position at which the clamp jig 20 mounted to the mounting unit 41 is to be transferred to the robot arm 30. The conveyor device 40 is arranged so that the operation position is located outside the display device 50 and the transfer position is located inside the display device 50.

Conveyor Device

Figure 3:
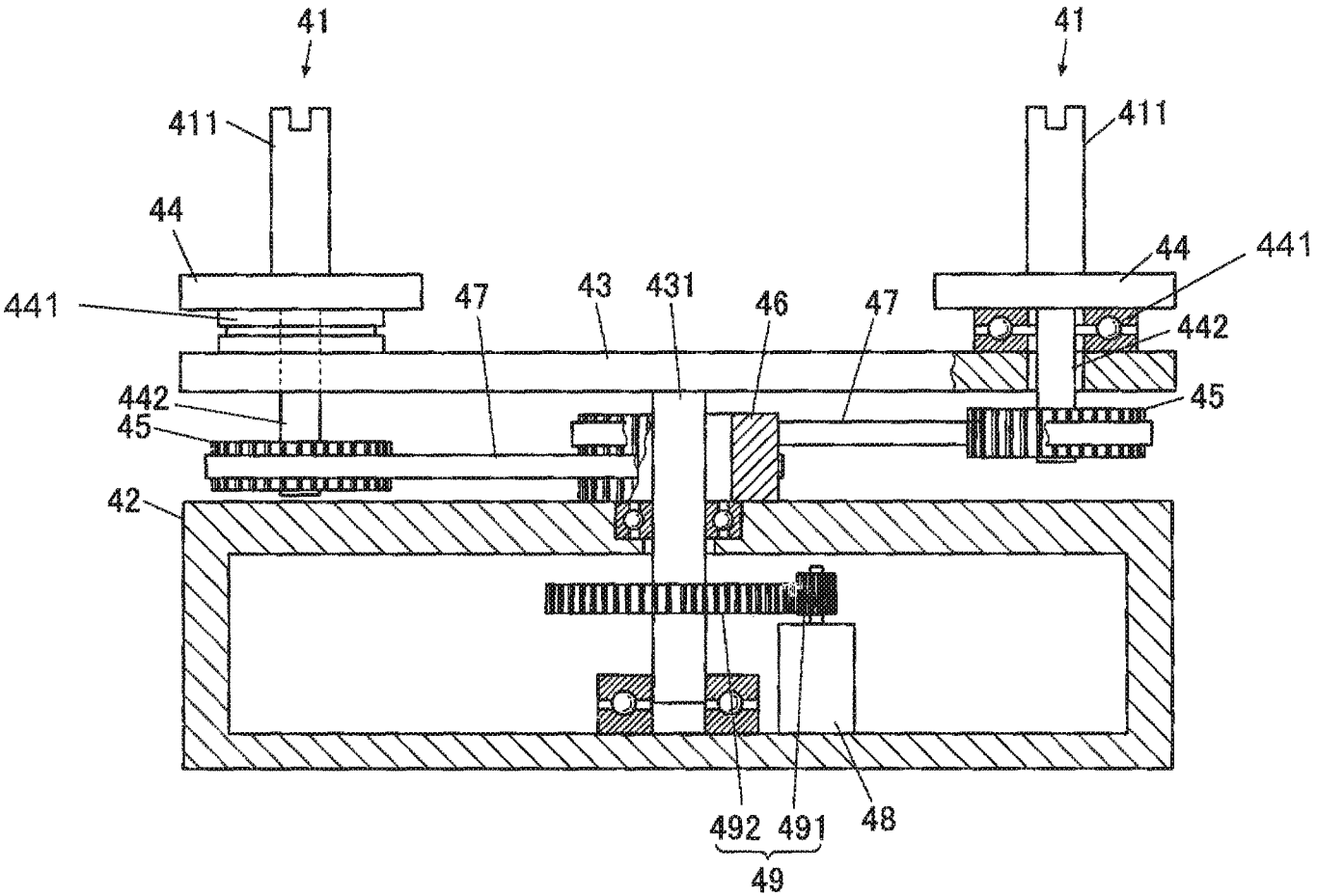
FIG. 3 is a sectional view of a conveyor device.
Figure 4:
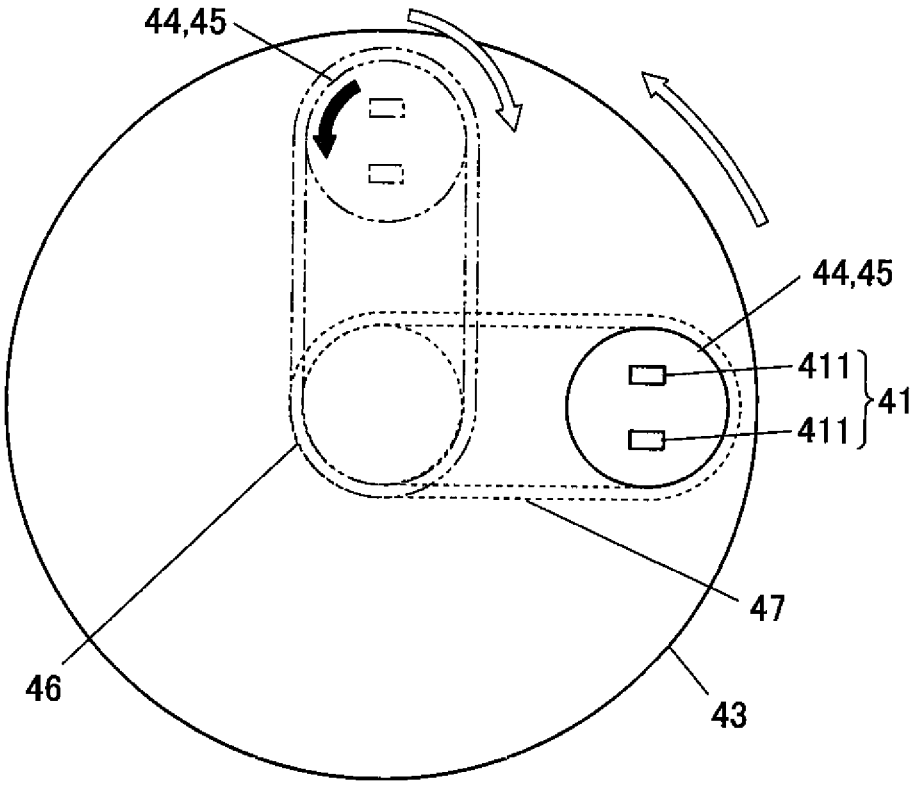
FIG. 4 is a plan view of a turntable of the conveyor device.

FIG. 3 is a sectional view of the conveyor device 40, and FIG. 4 is a plan view of a turntable 43 of the conveyor device 40.

As shown in FIG. 3, the conveyor device 40 includes a base 42, a turntable 43 rotatably supported around a vertical shaft by the base 42, two support bases 44 rotatably supported around vertical shafts on an upper surface of the turntable 43, mounting units 41 mounted on upper surfaces of the respective support bases 44 and configured to mount thereon the clamp jig 20 at a predetermined posture, driven pulleys 45 fixedly mounted concentrically with the respective support bases 44, a driving pulley 46 fixedly mounted on an upper surface of the base 42 concentrically with the turntable 43, a timing belt 47 provided between the driving pulley 46 and each of the driven pulleys 45, a conveyor motor 48, which is a rotation driving source of the turntable 43, and a transmission mechanism 49 configured to transmit a rotational force from the conveyor motor 48 to the turntable 43.

The turntable 43 has a circular disc shape and a vertical support shaft 431 is fixedly mounted to a center of a lower surface of the turntable. Also, the two support bases 44 are individually mounted at both diametrical end portions of the upper surface of the turntable 43. The turntable 43 is configured to rotate by 180° around the support shaft 431, thereby conveying each support base 44 from the operation position to the transfer position or from the transfer position to the operation position.

The support shaft 431 of the turntable 43 is rotatably supported by a bearing mounted to the base 42 with passing through a center of the upper surface of the base 42.

In the base 42, the conveyor motor 48 and the transmission mechanism 49 are accommodated and mounted. The transmission mechanism 49 includes a pinion 491 mounted to an output shaft of the conveyor motor 48 and a gear wheel 492 fixedly mounted to the support shaft 431 of the turntable 43, and is configured to reduce and transmit rotation of the conveyor motor 48 to the turntable 43.

Each support base 44 is a small circular disc, and the mounting unit 41 configured to mount the clamp jig 20 in a predetermined direction and at a predetermined posture is mounted on an upper surface of the support base. The mounting unit 41 includes a pair of struts 411, and an upper end portion of each strut 411 is formed with a fitting groove to which a predetermined part of the frame 22 of the clamp jig 20 is to be fitted. Therefore, the clamp jig 20 is mounted so that the frame 22 is to be fitted to the fitting grooves. Thereby, the clamp jig 20 is held at the mounting units 41 in a predetermined direction and at a predetermined posture.

Also, the conveyor device 40 is arranged next the robot arm 30, and the clamp jig 20 is mounted to the mounting unit 41 at a state where the tool plate 23 mounted on the back surface-side of the frame 22 faces towards the robot arm 30. Therefore, it is possible to easily connect the master plate 31 of the robot arm 30 to the tool plate 23 of the clamp jig 20 and to easily maintain the clamp jig 20 by the robot arm 30.

The support base 44 is rotatably supported around the vertical shaft on the upper surface of the turntable 43 via a thrust bearing 441. Also, a vertical support shaft 442 is fixedly mounted to the center of the lower surface of the support base 44 with being loosely fitted to the thrust bearing 441. The support shaft 442 is loosely fitted to a through-hole formed in the turntable 43, too, and a lower end portion of the support shaft 442 extends to a lower side of the turntable 43. The driven pulley 45 is fixedly mounted to the lower end portion of the support shaft 442.

The driven pulley 45 is applied with a rotational force from the driving pulley 46 through the timing belt 47.

The driving pulley 46 has a cylindrical shape and the support shaft 431 of the turntable 43 is loosely fitted thereto. Also, the driving pulley 46 is fixed to the upper surface of the base 42, and an outer diameter thereof is the same as the driven pulley 45.

The respective support bases 44 can be held so that when the turntable 43 is rotated by the driving pulley 46, the support bases do not cause the rotation to the base 70 of the sewing system 100.

For example, as shown in FIG. 4, when the turntable 43 is rotated in a counterclockwise direction by 90°, the support base 44 is rotated in the counterclockwise direction by 90°, like the turntable 43, if an external force is not applied. However, actually, since the driven pulley 45 is applied with rotations of 90° in a clockwise direction by the timing belt 47 provided between the driven pulley and the driving pulley 46, the rotation of the support base 44 is cancelled, so that the direction of the support base is kept, as seen from the base 70. This is also the same in a case where a rotating direction or a rotating angel of the turntable 43 is changed, too. Therefore, even when the turntable 43 is rotated in any manner, the direction of the support base 44 is kept.

Also, in FIG. 3, only the support base 44 and driven pulley 45 of one side are shown, and the other side is not shown.

The conveyor device 40 is configured so that a position at which the support base 44 and the mounting unit 41 are located outside the display device 50 is the operation position at which the clamp jig 20 is to be mounted to the mounting unit 41 and a position obtained by rotating the turntable 43 by 180° from the operation position is the transfer position at which the clamp jig 20 mounted to the mounting unit 41 inside the display device 50 is to be transferred to the robot arm 30.

Therefore, the two support bases 44 and mounting units 41 arranged at an angle interval of 180° on the turntable 43 are respectively arranged so that when one is located at the operation position, the other is located at the transfer position.

Also, the conveyor device 40 can convey the clamp jig 20 to the operation position while maintaining the direction in which the clamp jig 20 is mounted to the mounting unit 41 when each support base 44 is located at the operation position.

Control System of Sewing Machine

Figure 5:
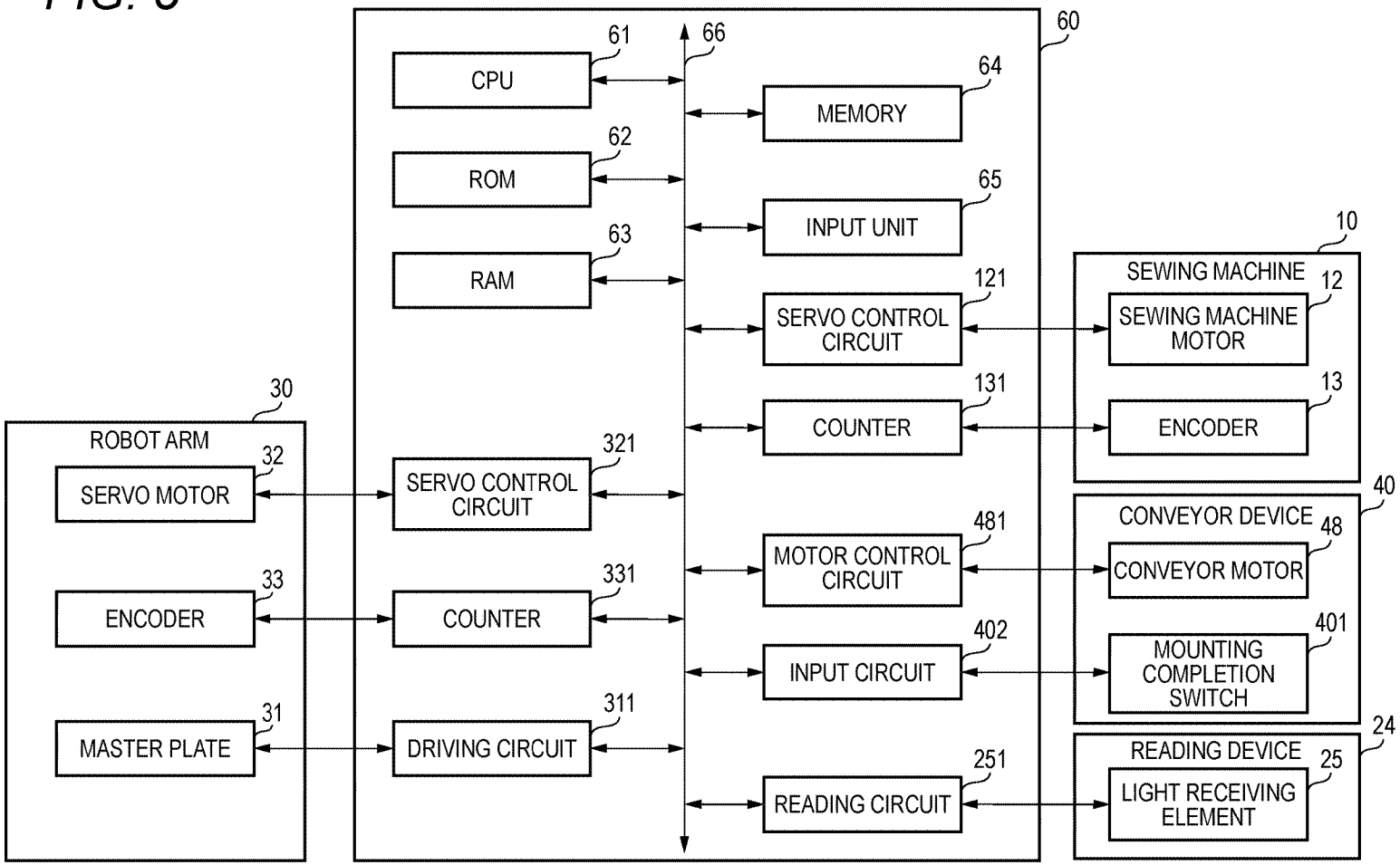
FIG. 5 is a block diagram depicting a control system of the sewing system.

FIG. 5 is a block diagram of the controller 60.

The controller 60 includes a ROM 62 in which a variety of programs including a control program for controlling interlocking operations of the sewing machine 10, the robot arm 30 and the conveyor device 40 are stored, a CPU 61 configured to execute the various programs stored in the ROM 62, a RAM 63 becoming a work area in which diverse data is to be stored by processing of the CPU 61, a non-volatile memory 64 in which a variety of control data, which is required for processing of the control program, such as a target position, a moveable range and the like of the robot arm 30 is stored, an input unit 65 such as a keyboard and an interface thereof for inputting a teaching point of the robot arm 30 and other diverse settings, and a bus 66 connecting the respective constitutional elements so that signals thereof are to be transmitted and received.

The controller 60 includes a servo control circuit 321 configured to supply a driving current to the servo motor 32 of each joint of the robot arm 30, in accordance with a torque value, a counter 331 configured to count an output of the encoder 33 of each joint, a driving circuit 311 of an actuator configured to couple and decouple the tool plate 23 by the master plate 31, a servo control circuit 121 configured to supply a driving current to the sewing machine motor 12, which is a servo motor configured to enable the sewing operation of the sewing machine 10, in accordance with a torque value, a counter 131 configured to count an output of an encoder 13 provided in parallel with the sewing machine motor 12, a motor control circuit 481 configured to drive the conveyor motor 48, which is a stepping motor configured to perform a conveying operation of the clamp jig 20 by the conveyor device 40, in accordance with a target value, an input circuit 402 configured to detect an input of mounting completion of a mounting completion switch 401 by which an operator inputs mounting operation completion of the clamp jig 20 to the mounting unit 41 located at the operation position, and a reading circuit 251 configured to generate type data of the workpiece from a reading signal from a light receiving element 25 in a reading device 24 configured to read a barcode indicative of a type of the workpiece applied to the clamp jig 20.

Also, the counter 331 and the servo control circuit 321 are individually provided for each servo motor 32 of each joint of the robot arm 30. However, in FIG. 5, only one is respectively shown, and the other servo motors 32 and encoders 33 are not shown.

Operation Control of Conveyor Device Upon Sewing

The controller 60 is configured to control the sewing machine 10, the robot arm 30 and the conveyor device 40 in an interlocking manner and to execute sewing control of the workpiece, through operation control to be described later.

Figure 6:
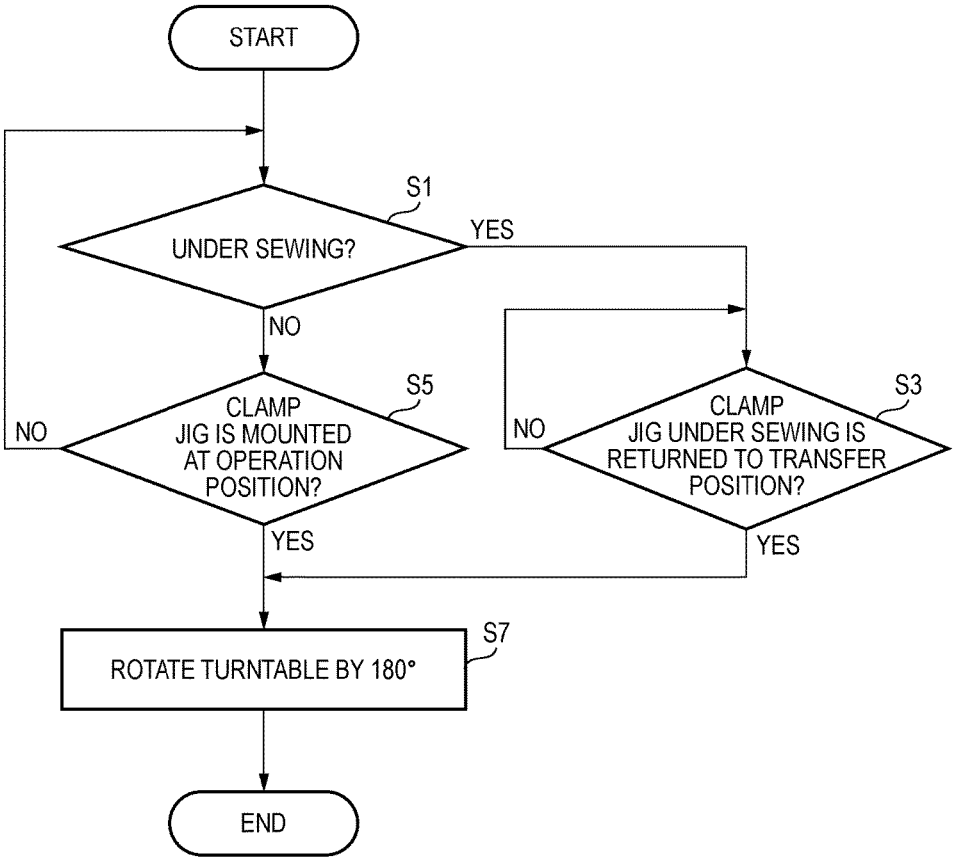
FIG. 6 is a flowchart depicting operation control of the conveyor device upon a sewing operation.

First, the operation control of the conveyor device 40 is described on the basis of a flowchart of FIG. 6.

The CPU 61 of the controller 60 first determines whether the sewing machine 10 is performing the sewing operation (step S1).

When it is determined that the sewing operation is being performed (step S1: YES), the CPU determines whether the clamp jig 20, which holds the workpiece for which the sewing operation is currently performed, is returned to the empty mounting unit 41 by the robot arm 30 as the sewing operation is completed, at a state where the empty mounting unit 41 is enabled to stand by at the transfer position (step S3).

The CPU repeatedly executes the determination until the clamp jig 20 is returned to the empty mounting unit 41. When the clamp jig 20 is returned to the empty mounting unit 41, the CPU controls the conveyor motor 48 to rotate the turntable 43 by 180°, and conveys the clamp jig 20, which holds the workpiece for which the sewing operation has been completed, from the transfer position to the operation position (step S7).

Thereby, the operator can perform operations of detaching and collecting the clamp jig 20, which holds the workpiece for which the sewing operation has been completed, from the mounting unit 41, and mounting the clamp jig 20, which holds a new workpiece for which the sewing operation is not performed yet, to the mounting unit 41.

Also, when it is determined that the sewing operation is not currently performed (step S1: NO), the CPU determines whether the clamp jig 20, which holds the workpiece for which the sewing operation is not performed yet, is mounted to the mounting unit 41 located at the operation position, depending on whether an input is made through the mounting completion switch 401 provided for the conveyor device 40 (step S5).

When it is determined that the clamp jig is not mounted yet (step S3: NO), the CPU returns to the processing of step S1 and determines whether the sewing machine 10 is performing the sewing operation (step S1).

Also, when it is determined that the clamp jig 20 is mounted to the mounting unit 41 located at the operation position, the CPU controls the conveyor motor 48 to rotate the turntable 43 by 180°, and conveys the clamp jig 20, which holds the workpiece for which the sewing operation is not performed yet, from the operation position to the transfer position (step S7).

Thereby, the robot arm 30 can hold the clamp jig 20, which holds the workpiece for which the sewing operation is not performed yet, so that it is possible to supply the workpiece from the conveyor device 40 to the sewing machine 10 and to sew the same.

Operation Control of Robot Arm and Sewing Machine Upon Sewing

Figure 7:
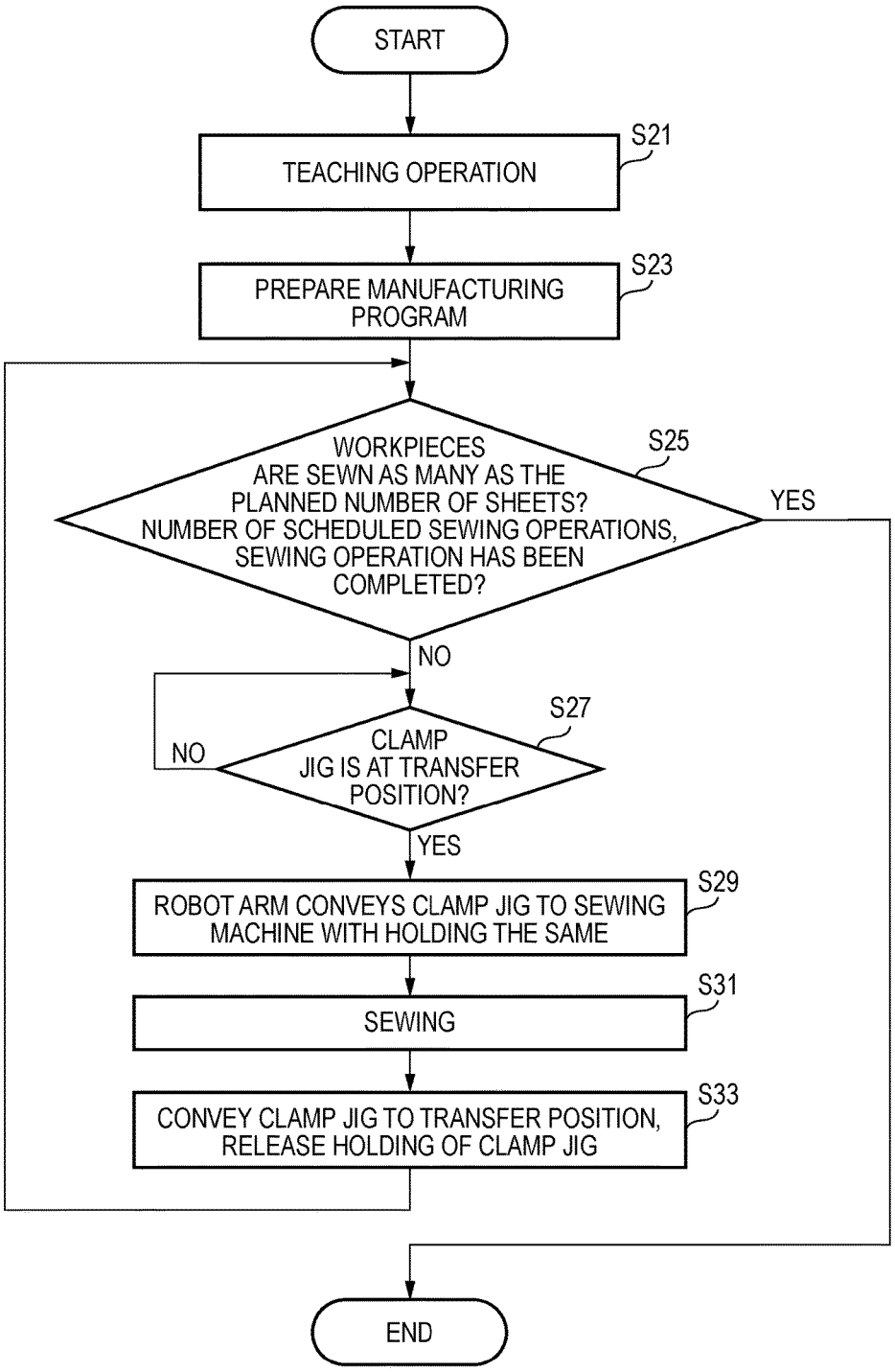
FIG. 7 is a flowchart depicting operation control of a robot arm and a sewing machine upon the sewing operation.

Subsequently, the operation control of the robot arm 30 and the sewing machine 10 upon the sewing is described on the basis of a flowchart of FIG. 7.

First, an operation of teaching the controller 60 main passing points so as to determine a locus of the moving operation of the robot arm 30 is performed (step S21). Thereby, a position at which the master plate 31 is to be coupled to the tool plate 23 of the clamp jig 20 of the mounting unit 41 located at the transfer position of the conveyor device 40, a moving path between the transfer position and the sewing machine 10, a sewing start position of the clamp jig 20 relative to the sewing machine 10, and the like are set.

The teaching operation is performed through the input unit 65. However, when inputting each position, the robot arm 30 performs a follow-up operation. Therefore, it is possible to set each position while seeing the actual tip end position of the robot arm 30.

Also, in the teaching operation step, the reading device 24 reads a barcode indicative of a type of the workpiece provided for the clamp jig 20. When the reading is performed, an ID indicative of a type of the workpiece is specified, and a sewing pattern, size data of the clamp jig and the like, which correspond to the ID, are read out from a variety of data registered in the memory 64.

Also, the sewing pattern, the size data of the clamp jig and the like, which correspond to the ID, may be acquired by mounting a communication unit with an external network to the controller 60 and connecting a server, in which information relating to the workpiece is stored, through the network.

Then, the CPU 61 of the controller 60 prepares a manufacturing program (step S23). That is, an operation program of the robot arm 30 is generated on the basis of the position setting and acquired sewing pattern based on the teaching operation, and an operation timing and an operation condition for operating the sewing machine 10 and the conveyor device 40 in cooperation are set.

Also, since the size data of the clamp jig 20 is acquired in step S21, the operation program of the robot arm 30 is generated on the basis of the size data so that an operation is to be performed within the operation range defined by the display device 50 at a state where the robot arm 30 holds the clamp jig 20.

Also, the processing of step S21 and S23 may be omitted in second and thereafter sewing operations for the same type of the workpiece.

Then, the CPU 61 counts the number of completed sewing operations upon start of the sewing operation and determines whether it reaches the number of scheduled sewing operations (step S25). Also, the corresponding determination is performed whenever the sewing operation is performed.

When the number of completed sewing operations reaches the number of scheduled sewing operations (step S25: YES), the entire operation control is over.

Also, when the number of completed sewing operations does not reach the number of scheduled sewing operations (step S25: NO), the CPU determines whether the clamp jig 20, which holds the workpiece for which the sewing operation is not performed yet, stands by at the transfer position, from an operation hysteresis of the conveyor device 40 (step S27).

When it is determined that the clamp jig does not stand by (step S27: NO), the CPU repeatedly executes the determination, and when it is determined that the clamp jig stands by (step S27: YES), the CPU enables the robot arm 30 to execute the operation of coupling the master plate 31 to the tool plate 23 of the stand-by clamp jig 20 and conveys the clamp jig 20 to a sewing start position of the sewing machine 10 with holding the clamp jig (step S29).

Then, the CPU 61 drives the sewing machine motor 12 of the sewing machine 10, and enables the robot arm 30 to perform an operation of positioning the clamp jig 20 so that the needles are to sequentially drop to the needle drop positions determined in the sewing pattern data in synchronization with the rotating speed of the sewing machine motor 12 (step S31).

When the sewing operation is performed at all the needle drop positions determined in the sewing pattern data, the CPU 61 stops the sewing machine motor 12, conveys the clamp jig 20 to the mounting unit 41 located at the transfer position of the conveyor device 40, and releases the coupled state of the tool plate 23 with the master plate 31 (step S33).

The conveyor device 40 conveys the clamp jig 20 of the mounting unit 41 to the operation position in accordance with the operation control of FIG. 6.

Also, the CPU 61 counts the number of completed sewing operations every time and counts up the number of sewing operations when the sewing operation is completed.

The CPU 61 returns to the processing of step S25 and compares the number of completed sewing operations and the number of scheduled sewing operations. When the number of completed sewing operations reaches the number of scheduled sewing operations (step S25: YES), the CPU ends the entire operation control, and otherwise, the CPU proceeds to the processing of step S27 and executes a next sewing operation.

Effects of Illustrative Embodiment

As described above, according to the sewing system 100, the sewing machine 10 and the robot arm 30 are fixedly supported at the fixed positions by the base 70. Therefore, when the target position of the robot arm 30 for the sewing operation is once set, the relative positional relation between the robot arm 30 and the sewing machine 10 is kept by the base 70 even though the sewing system 100 is moved thereafter. Thus, it is not necessary to again perform the setting operation of the target position for the sewing operation, so that it is possible to reduce the burdens on the teaching operation and the other setting operation.

Also, according to the sewing system 100, the conveyor device 40 is also fixedly supported at the fixed position of the base 70. Therefore, the relative positional relation between the robot arm 30 and the conveyor device 40 can also be kept after the sewing system 100 is moved, and it is not necessary to perform the resetting operation of the target position after the sewing system 100 is moved, so that it is possible to further reduce the burdens on the teaching operation and the other setting operation.

Also, the robot arm 30 of the sewing system 100 is configured to hold the workpiece through the clamp jig 20, and the master plate 31 is mounted at the robot arm 30-side and the tool plate 23 is mounted at the clamp jig 20-side between the robot arm 30 and the clamp jig 20, as the coupling structure configured to be detachably mounted from the robot arm 30-side and to hold the clamp jig 20 at the predetermined posture. Therefore, it is possible to easily hold and release the workpiece by the robot arm 30.

Also, the clamp jig 20 can hold the workpiece in diverse forms such as a circumferential surface shape, a curved surface shape and the like, without being limited to the planar shape, and the robot arm 30 can drop the needle to any position of the workpiece held in the stereoscopic form, from any direction. Therefore, it is possible to perform the favorable sewing operation for the workpiece having a stereoscopic shape for which it was difficult to perform the sewing operation by the sewing machine of the related art.

Also, the sewing system 100 includes the display device 50 supported at the fixed position of the base 70 and indicative of the moveable range of the robot arm 30. Therefore, the operator can efficiently avoid the contact with the robot arm 30.

Also, the conveyor device 40 is arranged so that the operation position is located at the outside of the moveable range and the transfer position is located at the inside of the moveable range. Therefore, it is possible to mount the clamp jig 20 at the outside of the moveable range, so that the operator can more efficiently avoid the contact with the robot arm 30.

Also, the conveyor device 40 has the configuration where the support base 44 is coupled to the driving pulley 46 through the driven pulley 45 and the timing belt 47. Therefore, it is possible to transfer the clamp jig 20 to the robot arm 30 at the transfer position in the same posture and direction as the posture and direction of the clamp jig 20 mounted to the mounting unit 41 at the operation position.

For this reason, the operator can perform the mounting operation of mounting the clamp jig 20 to the mounting unit 41 with the front surface of the clamp jig 20 facing towards the operator, so that the operator can easily perform the mounting operation. Also, since it is possible to mount the clamp jig 20 to the mounting unit 41 in the same direction as the direction in which the clamp jig 20 is to be directly transferred to the robot arm 30, it is possible to reduce a directional error upon the mounting operation.

Also, since the base 70 of the sewing system 100 has the casters 71 for moving, it is possible to easily move the entire sewing system 100.

Others

The mounting unit 41 on the turntable 43 of the conveyor device 40 is configured to keep the direction thereof upon the rotation of the turntable 43 by the respective pulleys 45, 46 and the timing belt 47. However, other mechanisms can also be used inasmuch as the same effects can be accomplished.

Figure 8:
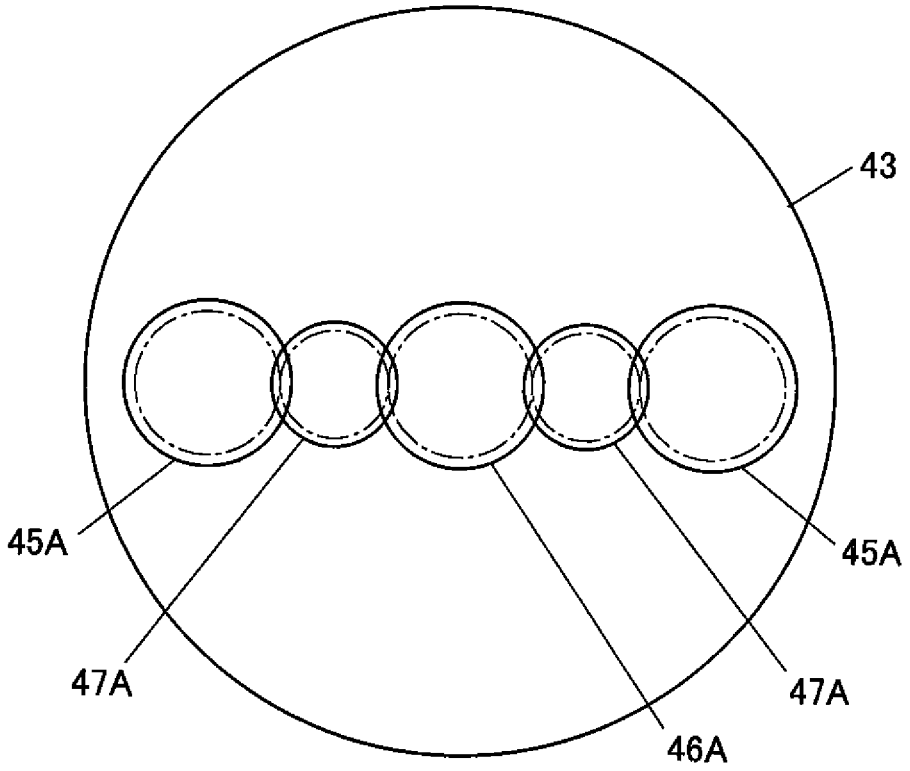
FIG. 8 is a bottom view of the turntable depicting another example of the conveyor device.

For example, a configuration as shown in FIG. 8 depicting the turntable 43 from below may be adopted. That is, the lower end portion of the support shaft 442 of each support base 44 is mounted with driven gears 45A, instead of the driven pulleys 45, the center position of the upper surface of the base 42 is mounted with a driving gear 46A, instead of the driving pulley 46, and transfer gears 47A configured to mesh both the driving gear 46A and the driven gears 45A are rotatably mounted on the lower surface of the turntable 43. In this case, as the driving gear 46A and the driven gear 45A, gears having the same effective diameter and number of teeth should be used. Also, the transfer gear 47A is not required to have the same effective diameter and number of teeth, and a gear capable of meshing with both the gears may be used.

Also in the above configuration, when the turntable 43 rotates, rotation cancelling the rotation is provided to the support base 44, so that it is possible to constantly keep the direction of the mounting unit 41.

Also, in the configurations where the pulleys 45, 46 and the timing belt 47 or the gears 45A, 46A, 47A are used, it is possible to constantly keep the direction of the mounting unit 41 all the time, irrespective of the rotating angle of the turntable 43, but the present invention is not limited thereto.

When the mounting units 41 are located at the operation position and the transfer position, they may be rotated in any direction during the movement because the directions have only to coincide with each other.

For example, in the configuration where the turntable 43 rotates by 180° to reciprocate between the operation position and the transfer position, like the conveyor device 40, a mechanism may be mounted which, when the turntable 43 rotates by 180°, rotates the support base 44 by 180° in the same direction as the rotation direction, not the direction of cancelling the rotation. Specifically, a configuration where a driven gear is mounted on the lower end portion of the support shaft 442 of the support base 44, a driving gear configured to directly mesh with the driven gear is mounted on the upper surface of the base 42 concentrically with the turntable 43, and the driving gear and the driven gear are made to have the same effective diameter and number of teeth may be adopted.

Also, the display device 50 is not limited to the structure of physically preventing the inward contact by the aggregate and the wall surface part, as described above. For example, a configuration enabling the operator to recognize the moveable range of the robot arm is possible, only the aggregate may be used, and the moveable range of the robot arm may be indicated by light, such as a light curtain.

Also, a unit configured to define a moveable range of the robot arm 30, which is not necessarily required to be recognized by the operator, and to detect introduction of a part or all of movement of the operator into the moveable range may be used. In this case, when introduction of a part or all of movement of the operator into the moveable range is detected, the control is preferably performed so as to stop the operation of the robot arm 30.

The conveyor device 40 is provided with the mounting completion switch 401 and the mounting of the clamp jig 20 to the mounting unit 41 is detected. However, the present invention is not limited thereto. For example, a detection element such as a micro switch configured to detect the mounting of the clamp jig 20 to the mounting unit 41 may be provided, and the mounting of the clamp jig 20 may be detected by sensing.

Also, the clamp jig 20 is provided with the barcode, and the sewing system 100 includes the reading device 24. However, the present invention is not limited thereto. For example, the clamp jig 20 may be mounted with a near field wireless information terminal such as an RFID (radio frequency identifier), a reading device therefor may be mounted near or at the mounting unit 41, and the type information and the like of the workpiece may be automatically acquired upon the mounting operation.

In this case, since the reading device is configured to automatically detect the near field wireless information terminal and to perform communication, it is possible to detect the mounting of the clamp jig 20 by the communication, so that it is possible to use the reading device, instead of the mounting completion switch 401.

The invention claimed is:

1. A sewing system comprising:

a sewing machine configured to sew a workpiece;

a robot arm which the workpiece is to be detachably held thereto and which is configured to position the held workpiece relative to the sewing machine and to enable any sewing operation;

a unitary base to which the sewing machine and the robot arm are fixedly supported at fixed positions;

a conveyor device comprising a mounting unit to which a clamp jig is to be mounted at a predetermined posture and configured to convey the mounting unit between an operation position at which an operation of mounting the clamp jig to the mounting unit is to be performed and a transfer position at which the clamp jig mounted to the mounting unit is to be transferred to the robot arm, wherein the conveyor device is fixedly supported at a fixed position of the base; and a display device supported at a fixed position of the base and configured to indicate a moveable range of the robot arm, wherein the conveyor device is arranged so that the operation position is located at an outside of the moveable range and the transfer position is located at an inside of the moveable range.

2. The sewing system according to claim 1, wherein the robot arm is configured to hold the workpiece through the clamp jig, and wherein a coupling structure configured to be detachably mounted from the robot arm-side and to hold the clamp jig at a predetermined posture is provided between the robot arm and the clamp jig.

3. The sewing system according to claim 1, wherein the conveyor device is configured to transfer the clamp jig to the robot arm at the transfer position, in the same posture and direction as a posture and a direction of the clamp jig mounted to the mounting unit at the operation position.

4. The sewing system according to claim 1, wherein the base comprises casters.

* * * * *